US005736306A

United States Patent [19]

Evans et al.

[11] Patent Number: 5,736,306

[45] Date of Patent: Apr. 7, 1998

[54] PHOTOGRAPHIC SILVER HALIDE MATERIAL HAVING IMPROVED SPECTRAL CHARACTERISTICS

[75] Inventors: Gareth Bryn Evans, Potten End; John Kenneth Charles Kempster, Stanmore; Danuta Gibson, Garston, all of United Kingdom

[73] Assignee: Eastman Kodak Company, Rochester, N.Y.

[21] Appl. No.: 576,727

[22] Filed: Dec. 21, 1995

[30] Foreign Application Priority Data

Dec. 24, 1994 [GB] United Kingdom ..... 94/26275

[51] Int. Cl.[6] ..... G03C 1/46

[52] U.S. Cl. ..... 430/505; 430/502; 430/503; 430/543; 430/554; 430/555; 430/556; 430/557; 430/558; 430/546; 430/642; 430/567

[58] Field of Search ..... 430/502, 503, 430/505, 543, 554, 555, 556, 557, 558, 546, 567, 642

[56] References Cited

U.S. PATENT DOCUMENTS

| | | | |
|---|---|---|---|
| 3,674,490 | 7/1972 | Matejec | 96/48 |
| 3,748,138 | 7/1973 | Bissonette | 96/66.3 |
| 3,765,891 | 10/1973 | Travis | 96/55 |
| 3,822,129 | 7/1974 | Dunn | 96/60 |
| 4,097,278 | 6/1978 | Bissonette | 96/22 |
| 4,745,049 | 5/1988 | Ohbayashi et al. | 430/546 |
| 4,816,290 | 3/1989 | Heki et al. | 430/642 |
| 5,063,143 | 11/1991 | Hirose et al. | 430/419 |
| 5,591,568 | 1/1997 | Bagchi et al. | 430/546 |

FOREIGN PATENT DOCUMENTS

| | | | |
|---|---|---|---|
| 0 231 832 | 8/1987 | European Pat. Off. . | |
| 0 566 416 A1 | 10/1993 | European Pat. Off. . | |
| 0 668 535 A3 | 8/1995 | European Pat. Off. . | |
| 52 023 933 | 8/1975 | Japan . | |
| 62 237 448 | 4/1988 | Japan . | |
| 1560572 | 9/1976 | United Kingdom | G03C 5/42 |
| 91/12567 | 8/1991 | WIPO . | |
| WO 93/03418 | 2/1993 | WIPO . | |

*Primary Examiner*—Geraldine Letscher
*Attorney, Agent, or Firm*—J. Lanny Tucker

[57] ABSTRACT

Spectral properties of dye images produced from low silver halide coverage materials are improved by using dyes which are formed in the magenta, yellow and cyan image dye-forming units. These dyes have certain spectral characteristics, as determined by their unwanted absorptions, in combination with certain silver halide emulsion grain characteristics in each emulsion layer. In particular, reduction of unwanted absorptions can be achieved either with couplers per se which meet these characteristics or by the use of certain high-boiling solvents in the coupler dispersions at preferred levels.

16 Claims, No Drawings

PHOTOGRAPHIC SILVER HALIDE MATERIAL HAVING IMPROVED SPECTRAL CHARACTERISTICS

FIELD OF THE INVENTION

This invention relates to photographic silver halide materials containing low laydowns of silver halide that provide dye images having improved spectral characteristics.

BACKGROUND OF THE INVENTION

There has been a trend to reduce the amount of silver contained by photographic materials. There are various reasons why this has been done and these include reducing the cost, reducing the thickness of silver halide emulsion layers to gain sharpness advantages, reducing the environmental impact during and after processing.

One class of low silver photographic material is color material intended for redox amplification processes wherein the developed silver acts as a catalyst to the formation of dye image. This process can take place in a low volume processor, such as a low volume thin tank (LVTT), for example, as disclosed in U.S. Pat. No. 5,436,118.

Redox amplification processes have been described, for example in GB 1,268,126, GB 1,399,481, GB 1,403,418, GB 1,560,572, U.S. Pat. No. 3,748,138, U.S. Pat. No. 3,822,129 and U.S. Pat. No. 4,097,278. In such processes, color materials are developed to produce a silver image (which may contain only small amounts of silver) and are then treated with a redox amplifying solution (or a combined developer-amplifier) to form a dye image.

Oxidized color developer reacts with a color coupler to form the image dye. The amount of dye formed depends on the time of treatment or the availability of color coupler and is less dependent on the amount of silver in the image as is the case in conventional color development processes.

These materials could be films or papers, of the negative or reversal type. The dyes could be chromogenic dyes formed from oxidized color developing agent and color couplers, dyes which can be produced by different chemical processes or dye released from dye releasers by oxidized developer. It particularly relates to materials used for color prints from negatives using a chromogenic process of dye formation.

With redox (RX) development that uses developed silver surfaces to catalyze the oxidation of developer, the normal relationship between image dye amounts and the amounts of silver halide developed is broken.

It is highly desirable to reduce silver levels not only to save on manufacturing costs but also for the reduced environmental impact of the process.

Reducing the silver halide laydown will result in the number of silver centers contributing to an image being reduced to a point at which the consequences of the silver halide reduction are visible in the image. One of these visible consequences is the reduced covering power of the dye image. The degree of lowering of the covering power resulting is dependent on the ability of the dye to absorb light. At spectral regions where absorption is high, the covering power reduction is large while in regions away from the peak spectral absorption where the absorption is weak the reduction in covering power is small. The result is an apparent broadening of the dye spectral envelope due to the low silver levels used in these circumstances of high dye density yield (dye density/developed silver amount). The spectral broadening usually has adverse consequences in that it increases the "unwanted" absorption's in the spectral regions adjacent to the region where the main absorption occurs. This adversely affects the resulting color reproduction in that it reduces the color saturation of the resulting images.

Reduction of unwanted absorptions has been achieved, together with an improvement of the dye hue, in the yellow layer of redox amplification-processable materials by the incorporation of a gel pad beneath the yellow layer (EP-A-0,551,468) or by the use of couplers with improved covering power (UK Patent Application No. 9317035.5).

In non-redox, conventional processing the use of high-boiling solvents, particularly for the yellow layer, for the improvement of dye stability has been disclosed in EP-A-0,242,146. There was no discussion of the use of such solvents to reduce unwanted absorptions to give an improvement in overall color quality.

It would be desirable to improve the spectral properties of the dye images produced from low silver halide coverage materials.

SUMMARY OF THE INVENTION

According to the present invention there is provided a photographic silver halide color print material comprising a support and yellow, magenta and cyan dye image forming layer units comprising at least one silver halide emulsion layer and at least one dye image-forming coupler, the material containing a total silver halide coating weight less than 300 mg/m$^2$ (as silver), and the material having a dye image-forming efficiency (E) under conditions of use of above 30 where:

$$E = \frac{\text{Dye image } Dmax}{\text{Silver coverage (g/m}^2)}$$

characterized in that under conditions of use (1) the dye(s) formed in the magenta dye image forming unit have when tested in monochrome coatings with a cubic silver chloride emulsion of average edge length 0.29 and a silver coverage of 21.5 mg/m$^2$, an unwanted absorption in the blue of less than 0.35 density units and an unwanted absorption in the red of less than 0.19 density units, and/or (2) the dye(s) formed in the yellow dye image forming unit have when tested in monochrome coatings with a cubic silver chloride emulsion of average edge length 0.4 and a silver coverage of 27 mg/m$^2$, an unwanted absorption in the green of less than 0.19 density units, and/or (3) the dye(s) formed in the cyan dye image forming unit have when tested in monochrome coatings with a cubic silver chloride emulsion of average edge length 0.29 and a silver coverage of 18 mg/m$^2$, an unwanted absorption in the green of less than 0.28 density units, wherein the above densities are measured above stain densities using Status A densitometry at densities of 1.0 above stain in the appropriate main absorption band, the coatings having been processed using a redox development/amplification step in accordance with any of Example 1, 2 or 3.

DETAILED DESCRIPTION OF THE INVENTION

Status A densitometry is an internationally agreed set of spectral standards with which to measure red, green and blue densities.

In order to determine the unwanted densities a monochrome coating on reflection base containing silver halide of appropriate grain size and silver coverage and the particular coupler of interest is made. White light exposures are then made and, after processing, the density of the dye image produced is read in the red, green and blue spectral regions (Status A) at a density in the main spectral region at a density of about 1.0 all densities being determined above the densities measured of the support where no exposure occurred, i.e., above the stain densities.

The unwanted absorption's may be reduced by using a coupler the forms a dye that has spectral properties which are such that low unwanted absorption's are provided.

Examples of magenta couplers that give the desired results are pyrazolones, especially 2-equivalent pyrazolones, pyrazolotriazoles, pyrazoloazoles and azoloazoles, and in particular the following couplers:

M1

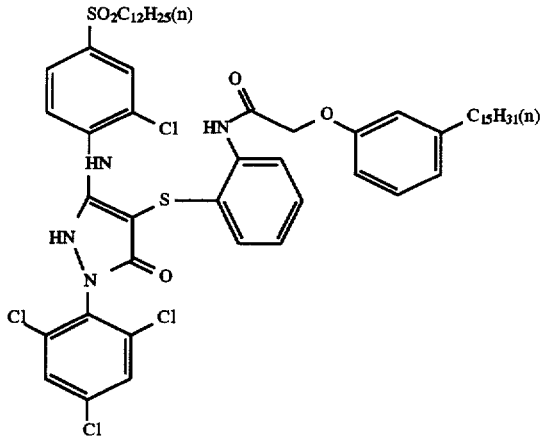

M2

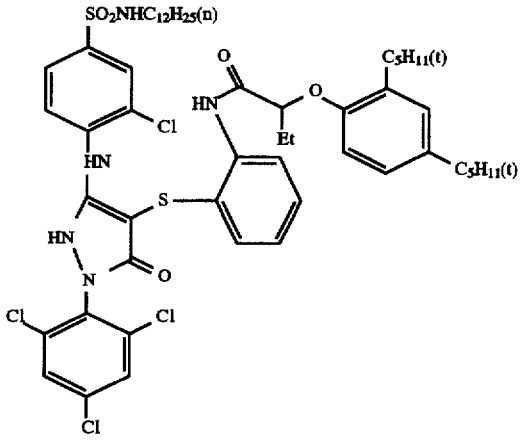

M3

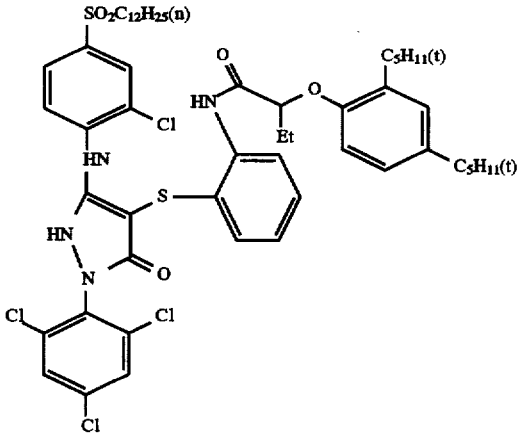

-continued
M4
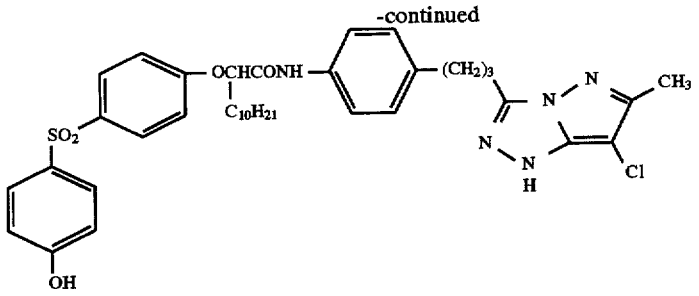
M5
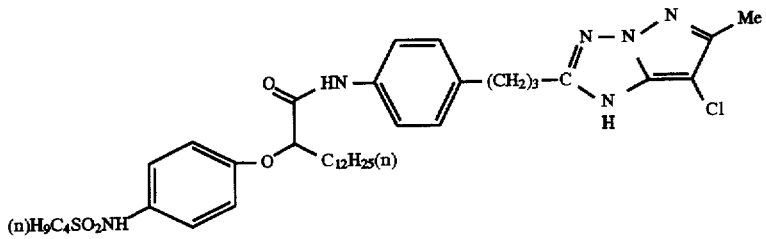
M6
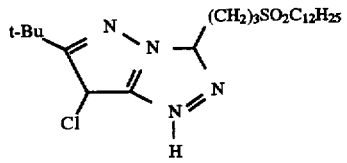
Examples of yellow couplers that give the desired results are those of the acetanilide type and in particular, include:
Y1
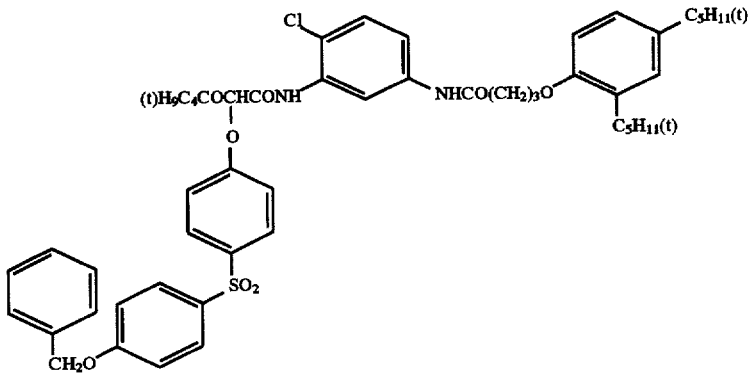

-continued

Y2

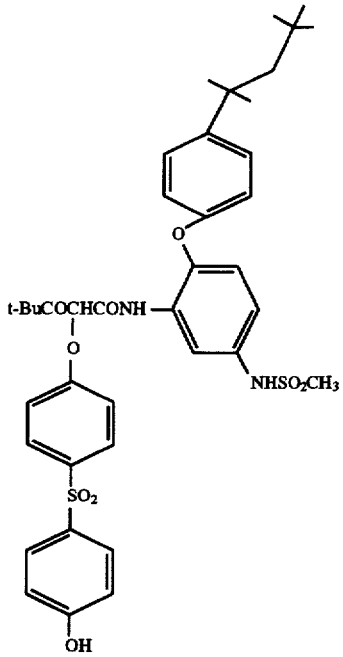

Y3

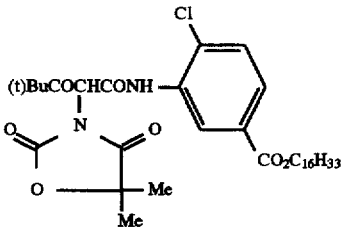

An example of a cyan coupler is the following:

C1

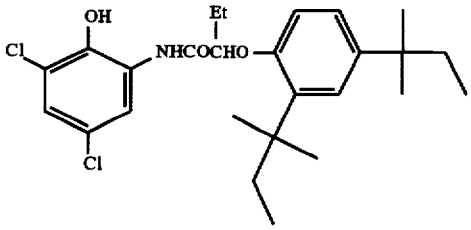

Alternatively the spectral properties can be altered by changes in the coupler dispersion formulation. Thus, the required characteristics may be obtained with a coupler that will not per se provide the desired spectral characteristics by using different coupler solvents. Such solvents include:

n-butylphtholate (S1)

tris (2-ethylhexyl)phosphate (S2)

N,N-diethyl lauramide (S3)

N,N-dibutyl lauramide (S4)

It will be understood that the exact nature and selection of the solvents will depend on the particular coupler involved.

It has also been found that increasing the levels of high-boiling solvents, such as the above, can lead to a reduction in unwanted absorptions of the dyes resulting from the use of both magenta and yellow dye-forming couplers when incorporated in the oil phase of conventional oil-in-water dispersions and used in color paper materials for redox amplification processes. In particular, coupler/solvent weight ratios from about 1:10 to about 1:0.2, especially 1:8 to about 1:2, have been found to be suitable, the optimum weight ratio being chosen for any particular coupler and solvent to provide a balance between unwanted absorption reduction, ease of manufacturing and cost considerations.

In a particular aspect of the invention, when solvent tris(2-ethylhexyl) phosphate (S2) is used with yellow dye-forming couplers, there is a significant hypsochromic shift in dye hue so that a more pleasing yellow dye hue is obtained.

The silver halide emulsions may be made by methods known to those in the art. The silver and halide solutions may be introduced into the precipitation vessel in known manner using one or two jets. Double jet precipitation of silver chloride emulsions together with control of pCl and pAg has the advantage that well-controlled cubic grains of comparatively uniform size may be formed.

The silver halide grains may be doped with Rhodium, Ruthenium, Iridium or other Group VIII metals either alone or in combination. The grains may be mono- or poly-disperse.

The silver halide grains may be, for example, doped with one or more Group VIII metal at levels in the range $10^{-9}$ to $10^{-3}$, preferably $10^{-6}$ to $10^{-3}$, mole metal per mole of silver. The preferred Group VIII metals are Rhodium and/or Iridium.

The total silver halide coating weight (all layers) is less than 300 mg/m$^2$ (as silver) and may range from 10 to 250 mg/m$^2$, preferably 25 to 150 mg/m$^2$ more preferably 40 to 120 mg/m$^2$ and especially 50 to 90 mg/m$^2$. In such materials the silver halide coating weight of the red and green sensitized layer may generally each comprise approximately one quarter of the total weight and the silver halide coating weight of the blue sensitized layer may comprise the remaining approximate one-half of the total weight.

The preferred silver halide emulsions may have cubic, octahedral or tabular grains and be of comparatively uniform grain size distribution. The preferred grain sizes are from 0.1 to 1.0 mm, preferably 0.25 to 0.60 mm and particularly from 0.15 to 0.5 mm.

The silver halide may comprise silver chloride, and is preferably more than 85% chloride, preferably more than 95% chloride. Particularly preferred are substantially pure silver chloride emulsions containing a maximum of 2% bromide. The preferred materials are paper color negative materials.

Modifying compounds can be present during grain precipitation. Such compounds can be initially in the reaction vessel or can be added along with one or more of the salts according to conventional procedures. Modifying compounds, such as compounds of copper, thallium, lead, bismuth, cadmium, zinc, sulfur, selenium, tellurium, gold, and Group VIII noble metals, can be present during silver halide precipitation, as illustrated by U.S. Pat. No. 1,195,432, U.S. Pat. No. 1,951,933, U.S. Pat. No. 2,448,060, U.S. Pat. No. 2,628,167, U.S. Pat. No. 2,950,972, U.S. Pat. No. 3,488,709, U.S. Pat. No. 3,737,313, U.S. Pat. No. 3,772,031, U.S. Pat. No. 4,20,927, and *Research Disclosure*, Vol. 134, June 1975, Item 13452.

It is specifically contemplated that grain ripening can occur during the preparation of silver halide emulsion according to the present invention, and it is preferred that grain ripening occurs within the reaction vessel during, at least, grain formation. Known silver halide solvents are useful in promoting ripening. Ripening agents can be employed and can be entirely contained within the dispersing medium in the reaction vessel before silver and halide salt addition, or they can be introduced into the reaction vessel along with one or more of the halide salt, silver salt, or peptizer. In still another variant the ripening agent can be introduced independently during halide and silver salt additions. Although ammonia is a known ripening agent, it is not a preferred ripening agent for the emulsions. The preferred emulsions of the present invention are non-ammoniac or neutral emulsions. Among preferred ripening agents are those containing sulfur. Thiocyanate salts can be used, such as alkali metal, most commonly sodium and potassium and ammonium thiocyanate salts. While any conventional quantity of the thiocyanate salts can be introduce preferred concentrations are generally from about 0.1 to 20 grams of thiocyanate salt per mole of silver halide. Illustrative prior teachings of employing thiocyanate ripening agents are found in Nietz et al, U.S. Pat. No. 2,222,264; U.S. Pat. No. 2,448,534 and U.S. Pat. No. 3,320,069. Alternatively, conventional thioether ripening agents, such as those disclosed in U.S. Pat. No. 3,271,157, U.S. Pat. No. 3,574,628, and U.S. Pat. No. 3,737,313 can be used.

The following Examples are included for a better understanding of the invention.

EXAMPLE 1

Optimally sensitized cubic silver chloride emulsion of edge length 0.29 mm, was coated with an incorporated dispersion of a magenta coupler to give magenta single color records suitable for redox amplification processing. The silver laydown was 21.5 mg/m$^2$. The prepared coatings were exposed and processed in a redox amplification process using the redox amplifier formulation and process sequence given below.

Formulation for 1.0 Liter of Redox Amplifier (DEV 1)

| | |
|---|---|
| 1-hydroxyethylidene-1,1'-diphosphonic acid | 0.6 g |
| diethyltriaminepentaacetic acid | 2.0 ml |
| $K_2HPO_4.3H_2O$ | 40.0 g |
| KBr | 1.0 mg |
| KCl | 0.5 g |
| KOH | 4.5 g |
| catechol disulfonate | 0.3 g |
| Hydroxylamine sulfate | 1.0 g |
| 4-N-ethyl-N-(β-methanesulfonamidoethyl)-o-toluidine sesquisulfate | 4.5 g |
| Water to | 1000.0 ml |
| pH (27° C.), adj with KOH to | 11.4 |
| Hydrogen peroxide (100 vol.) | 2.0 ml |

Process Sequence

| | |
|---|---|
| Develop in 8 liter tank 32° C. | 45 sec |
| Stop 15 g/l Na metabisulfite | 30 sec |
| Bleach Fix (EKTACOLOR ™ RA4) | 45 sec |
| Wash | 10 min. |

Density readings of red, green and blue densities were made and normalized to a green density of 1.0. The results together with the identity of the magenta coupler are reported below:

| | | | DENSITY (above stain) | | |
|---|---|---|---|---|---|
| COUPLER | E | Dmax | Green | Blue | Red |
| A (comparative) | 132.8 | 2.84 | 1.0 | 0.36 | 0.20 |
| B (comparative) | 128.0 | 2.77 | 1.0 | 0.35 | 0.22 |
| M1 | 135.9 | 2.91 | 1.0 | 0.27 | 0.13 |
| M2 | 134.3 | 2.90 | 1.0 | 0.29 | 0.15 |
| M3 | 129.2 | 2.76 | 1.0 | 0.28 | 0.14 |
| M4 | 148.5 | 2.95 | 1.0 | 0.27 | 0.16 |
| M5 | 139.2 | 2.95 | 1.0 | 0.32 | 0.16 |

The above results show that the magenta couplers of the invention exhibit reduced unwanted absorptions compared with the comparative couplers. The reduced unwanted absorption's enable multilayer materials to be made which provide color prints of excellent color saturation.

The comparative couplers are:

(A)

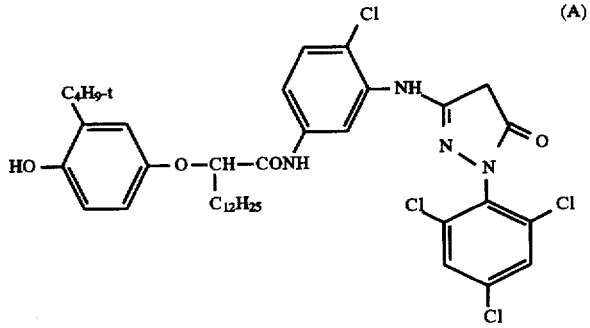

-continued (B)

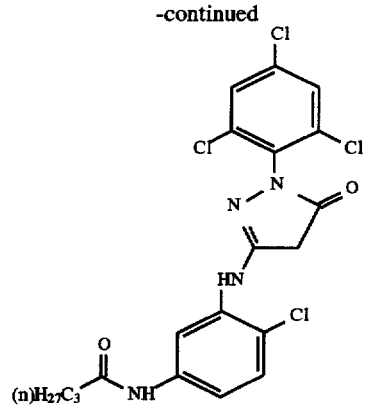

EXAMPLE 2

Optimally sensitized cubic silver chloride emulsion of edge length 0.4 μm, was coated with an incorporated dispersion of a yellow coupler to give yellow single color records suitable for redox amplification processing. The silver laydown was 27 mg/m$^2$. The prepared coatings were exposed and processed in a redox amplification process using the redox amplifier formulation and process sequence given below.

Density readings of green and blue densities were made and normalized to a blue density of 1.0.

Formulation for 1.0 Liter of Redox Amplifier (DEV2)

| | |
|---|---|
| 1-hydroxyethylidene-1,1'-diphosphonic acid | 0.6 g |
| diethyltriamine-pentaacetic acid | 2.0 ml |
| $K_2CO_3$ | 10.0 g |
| KBr | 1.0 mg |
| KCl | 0.35 g |
| Diethylhydroxylamine (85%) | 1.0 g |
| 4-N-ethyl-N-(β-methanesulfonamidoethyl)-o-toluidine sesquisulfate | 3.5 g |
| Water to | 1000.0 ml |
| pH (27° C.), adj. with KOH to | 10.3 |
| Hydrogen peroxide (100 vol) | 5.0 ml |

Process Sequence

| | |
|---|---|
| Develop in 8 liter tank at 32° C. | 45 sec |
| Stop 15 g/l sodium metabisulfite | 30 sec |
| Bleach Fix (EKTACOLOR ™ RA4) | 45 sec |
| Wash | 10 min |

Density readings of green and blue densities were made and normalized to a blue density of 1.0. The results are reported below.

| COUPLER | SOL-VENT | COUPLER: SOLVENT WEIGHT RATIO | E | Dmax | DENSITY (above stain) Blue | Green |
|---|---|---|---|---|---|---|
| Y1 | S1 | 1:0.25 | 38.6 | 1.97 | 1.00 | 0.13 |
| Y1 | S2 | 1:0.25 | 33.7 | 1.75 | 1.00 | 0.11 |
| Y1 | S2 | 1:1.00 | 45.0 | 2.29 | 1.00 | 0.09 |
| Y1 | S2 | 1:2.00 | 45.5 | 2.30 | 1.00 | 0.08 |
| Y2 | S1 | 1:0.50 | 38.4 | 1.86 | 1.00 | 0.14 |
| Y2 | S1 | 1:1.00 | 32.1 | 1.56 | 1.00 | 0.12 |
| Y2 | S2 | 1:0.50 | 32.2 | 1.56 | 1.00 | 0.13 |
| Y2 | S2 | 1:1.00 | 31.5 | 1.53 | 1.00 | 0.12 |

The results show that for both couplers, increasing the level of solvent tends to reduce unwanted green absorption. At low levels of solvent S2 is preferred to S1.

EXAMPLE 3

Optimal senstized cubic silver chloride emulsion of edge length 0.29 μm, was coated with an incorporated dispersion of a magenta coupler to give magenta single color records suitable for redox processing. The silver laydown was 21.5 mg/m$^2$. The prepared coatings were developed using the redox amplification process and sequence described in Example 2. Density readings of red, green and blue densities were made and normalized to a green density of 1.00. The results are reported below.

| A:S1 Weight Ratio | E | Dmax | Density (above stain) Green | Blue | Red |
|---|---|---|---|---|---|
| 1:0.5* | 9.4 | 2.10 | 1.00 | 0.26 | 0.16 |
| 1:0.5+ | 79.7 | 1.78 | 1.00 | 0.27 | 0.17 |
| 1:1.0 | 66.4 | 1.51 | 1.00 | 0.27 | 0.14 |
| 1:2.0 | 69.3 | 1.57 | 1.00 | 0.27 | 0.13 |

*Comparison — processed through EKTACOLOR ™ RA4 process.

The results show that for coupler A, as the level of solvent is increased, the amount of unwanted red absorption is reduced.

+ It should be noted that the E values for coupler A dispersed in the same way and coated with the same emulsion type and silver level is lower in the above Table (+) than the corresponding coating in Example 1. This is due to the greater degree of amplification produced under the processing conditions of Example 1. The lower degree of amplification results in lower unwanted absorptions in Example 3 compared with Example 1.

EXAMPLE 4

Optimally sensitzed cubic silver chloride emulsion of edge length 0.4 μm, was coated with an incorporated dispersion of yellow coupler to give yellow single color records suitable for redox amplification processing. The silver laydown Was 27 mg/m$^2$. The prepared coatings were exposed and processed in a redox amplification process using the redox amplifier formulation and process sequence as used in Example 1.

Density readings of green and blue densities were made and normalized to a blue density of 1.0.

| COUPLER | COUPLER SOLVENT | E | Dmax | DENSITY (above stain) Blue | Green |
|---|---|---|---|---|---|
| Y2 | S1 | 80.5 | 2.33 | 1.00 | 0.18 |
| Y2 | S2 | 77.3 | 2.19 | 1.00 | 0.15 |
| Y2 | S3 | 77.5 | 2.23 | 1.00 | 0.16 |
| Y1 | S1 | 77.8 | 2.10 | 1.00 | 0.15 |
| Y1 | S2 | 64.8 | 1.75 | 1.00 | 0.12 |
| Y1 | S4 | 85.8 | 2.32 | 1.00 | 0.13 |
| Y3 | S1 | 80.0 | 2.16 | 1.00 | 0.15 |
| Y3 | S2 | 80.7 | 2.18 | 1.00 | 0.14 |

S1=n-butylphthalate

S2=tris(2-ethylhexyl)phosphate

S3=N,N-dibutyl lauramide

S4=N,N-diethyl lauramide

The results show that solvents S2, S3 and S4 provide less unwanted green absorptions than solvent S1.

EXAMPLE 5

Optimal sensitized cubic silver chloride emulsion of edge length 0.29 μm, was coated with an incorporated dispersion of a magenta coupler to give magenta single color records suitable for redox processing. The silver laydown was 19.0 mg/m$^2$. The prepared coatings were developed using the redox amplification process and sequence described below.

Formulation for 1.0 Liter of Redox Amplifier (DEV3)

| | |
|---|---|
| 1-hydroxyethylidene-1,1'-diphosphonic acid | 0.6 g |
| diethyltriaminepentaacetic acid | 0.81 g |
| $K_2HPO_4$—$3H_2O$ | 40.0 g |
| KBr | 1.0 mg |
| KCl | 0.32 g |
| KOH | 4.5 g |
| Catechol disulfonate | 0.3 g |
| Hydroxylamine sulfate | 0.6 g |
| 4-N-ethyl-N-(β-methanesulfonamidoethyl)-o-toluidine sesequisulfate | 4.1 g |
| Water to | 1000.0 ml |
| pH (27° C.), adj. with KOH to | 11.4 |
| Hydrogen peroxide (100 vol) | 1.85 ml |

Process Sequence

| Process Sequence: | |
|---|---|
| Develop in 8 liter tank at 35° C. | 30 sec |
| Stop (40 g/l sodium metabisulfite, 12 g/l KOH) | 30 sec |
| Bleach Fix (EKTACOLOR ™ RA4) | 45 sec |
| Wash | 10 min |

Density readings of red, green and blue densities were made and normalized to a green density of 1.00. The results are reported below.

| COUPLER | E | Dmax | DENSITY (above stain) Blue | Green | Red |
|---|---|---|---|---|---|
| A* (comparative) | 11.3 | 2.55 | 1.00 | 0.27 | 0.17 |
| A (comparative) | 123.2 | 2.60 | 1.00 | 0.31 | 0.20 |
| M6 | 134.7 | 2.60 | 1.00 | 0.20 | 0.15 |

*Processed through EKTACOLOR ™ RA4 process.

The results show the effect of processing through DEV3 instead of RA4: unwanted blue and red absorptions are increased significantly. Coupler M6 shows less unwanted blue and red absorptions as a result of redox amplification processing than does coupler A.

EXAMPLE 6

Optimal sensitized cubic silver chloride emulsion of edge length 0.29 μm, was coated with an incorporated dispersion of a cyan coupler to give cyan single color recoreds suitable for redox processing. The silver laydown was 18.0 mg/m$^2$. The prepared coatings were developed using the DEV1 redox amplification process and sequence described in Example 1.

| COUPLER | E | Dmax | DENSITY (above stain) Blue | Green |
|---|---|---|---|---|
| C (comparative) | 96.3 | 1.83 | 1.00 | 0.32 |
| C1 | 144.7 | 2.46 | 1.00 | 0.27 |

The results show that coupler C1 has less unwanted green absorption than the comparative coupler C.

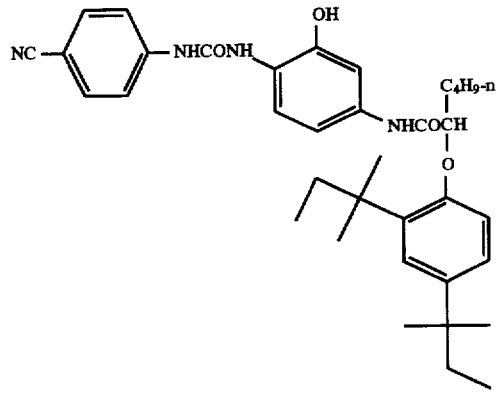

Comparative coupler, C

The invention has been described in detail with particular reference to preferred embodiments thereof, but it will be understood that variations and modifications can be effected within the spirit and scope of the invention.

We claim:

1. A photographic silver halide color print material comprising a support and yellow, magenta and cyan dye image forming layer units comprising at least one silver halide emulsion layer and at least one dye image-forming coupler, which material contains a total silver halide coating weight of less than 150 mg/m$^2$ (as silver), and wherein each image forming layer unit has a dye image-forming efficiency (E) of above 30 where:

$$E = \frac{\text{Dye image } Dmax}{\text{Silver coverage (g/m}^2)}$$

characterised in that:

(1) the dye(s) formed in the magenta dye image forming unit have, when tested in monochrome coatings with a cubic silver chloride emulsion of average edge length 0.29 μm and a silver coverage of 21.5 mg/m$^2$, an unwanted absorption in the blue of less than 0.35 density units and an unwanted absorption in the red of less than 0.19 density units, and/or (2) the dye(s) formed in the yellow dye image forming unit have, when tested in monochrome coatings with a cubic silver chloride emulsion of average edge length 0.4 μm and a silver coverage of 27 mg/m$^2$, an unwanted absorption in the green of less than 0.19 density units, and/or (3) the dye(s) formed in the cyan dye image forming unit have, when tested in monochrome coatings with a cubic silver chloride emulsion of average edge length 0.29 μm and a silver coverage of 18 mg/m$^2$, an unwanted absorption in the green of less than 0.28 density units, wherein the above densities are measured above stain densities using Status A densitometry at densities of 1.0 above stain in the appropriate main absorption band, the coatings having been processed using a redox development/amplification step in accordance with Example 1.

2. The photosensitive photographic silver halide material of claim 1 containing a magenta coupler or couplers that are selected from the following classes: pyrazolones, pyrazoloazoles, azoloazoles, and pyrazolotriazoles.

3. The photosensitive photographic silver halide material of claim 2 wherein the magenta dye-forming coupler is selected from

M1

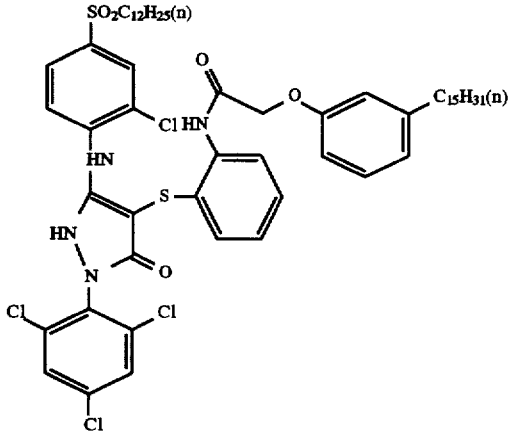

-continued

M2

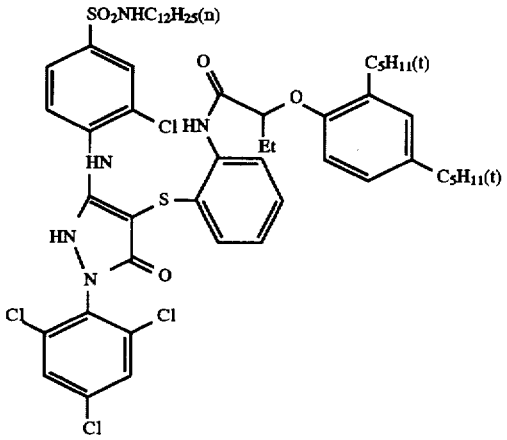

M3

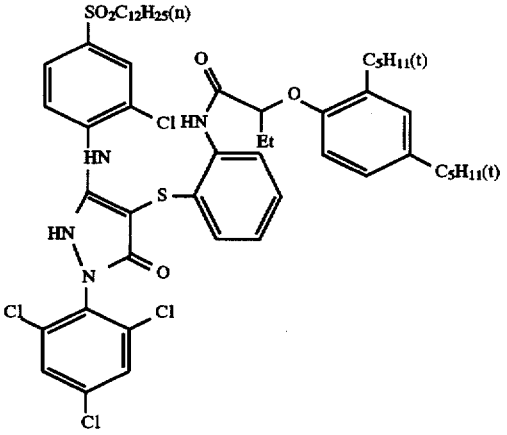

4. The photosensitive photographic silver halide material of claim 2 wherein the magenta dye-forming coupler is selected from

M4

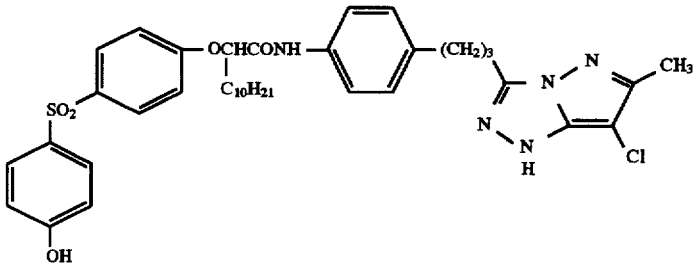

-continued

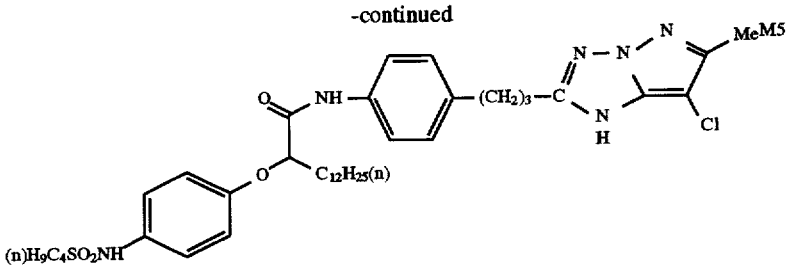

M5 and

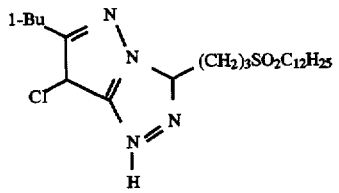

M6

5. The photosensitive photographic silver halide material of claim 1 containing an acetanilide yellow dye forming coupler.

6. The photosensitive photographic silver halide material of claim 5 in which the yellow dye-forming coupler has the formula:

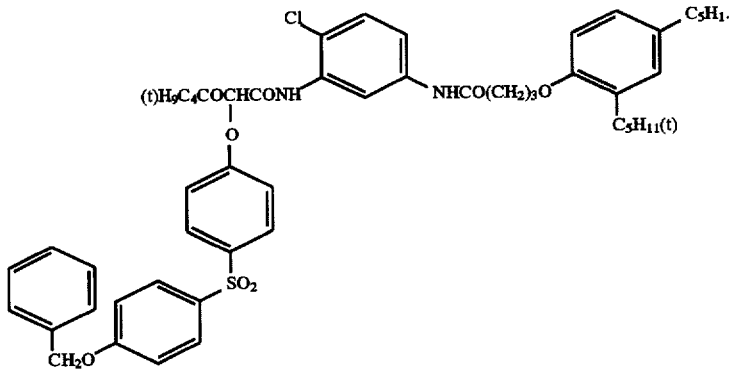

7. The photosensitive photographic silver halide material of claim 5 wherein the dye-forming coupler has the formula:

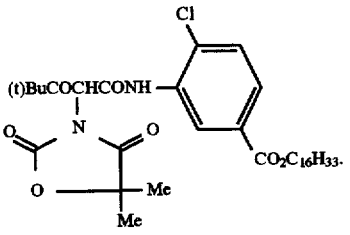

8. The photosensitive photographic silver halide material of claim 1 containing a coupler solvent in a coupler dispersion, the coupler solvent being capable of effecting the reduction in unwanted absorption of the dye to the required density units.

9. The photosensitive photographic silver halide material of claim 8 in which an increase in the level of the coupler solvent provides a corresponding reduction in unwanted absorptions.

10. The photosensitive photographic silver halide material of claim 8 wherein the weight ratio of coupler to solvent in the coupler dispersion is in the range from about 1:10 to about 1:0.2.

11. The photosensitive photographic silver halide material of claim 10 wherein the weight ratio of coupler to solvent in the coupler dispersion is in the range from about 1:8 to about 1:2.

12. The photosensitive photographic silver halide material of claim 8 in which the coupler solvent in the coupler dispersion is selected from n-butyl phthalate, tris(2-ethylhexyl) phosphate, N,N-diethyl lauramide and N,N dibutyl lauramide.

13. The photosensitive photographic silver halide material of claim 12 in which the coupler solvent in the dispersion of a yellow dye-forming coupler is tris(2-ethylhexyl) phosphate.

14. The photosensitive photographic silver halide material of claim 1 in which the silver halide emulsions comprise at least 85% silver chloride.

15. The photosensitive photographic silver halide material of claim 14 in which the silver halide emulsions comprise at least 95% silver chloride.

16. The photosensitive photographic silver halide material of claim 1 which has been processed in a low volume thin tank processor.

* * * * *